US008744304B2

(12) United States Patent
Sato

(10) Patent No.: US 8,744,304 B2
(45) Date of Patent: Jun. 3, 2014

(54) DEVELOPING DEVICE

(75) Inventor: Kensuke Sato, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 144 days.

(21) Appl. No.: 13/088,577

(22) Filed: Apr. 18, 2011

(65) Prior Publication Data

US 2011/0255897 A1 Oct. 20, 2011

(30) Foreign Application Priority Data

Apr. 20, 2010 (JP) ..... 2010-097113

(51) Int. Cl.
*G03G 15/08* (2006.01)

(52) U.S. Cl.
USPC ..... 399/104; 399/103

(58) Field of Classification Search
USPC ..... 399/102–104
See application file for complete search history.

(56) References Cited

U.S. PATENT DOCUMENTS 5,794,101 A * 8/1998 Watanabe et al. ..... 399/103

FOREIGN PATENT DOCUMENTS

| | | | |
|---|---|---|---|
| JP | 8-179625 A | | 7/1996 |
| JP | 9-26743 A | | 1/1997 |
| JP | 2000-75620 A | | 3/2000 |
| JP | 2001290370 A | * | 10/2001 |
| JP | 2003-5517 A | | 1/2003 |

OTHER PUBLICATIONS

Morioka (JP 2001-290370 A), Oct. 2001, JPO Machine Translation.*
Notification of Reason for Rejection mailed Sep. 11, 2012, in Japanese Application No. 2010-097113.

* cited by examiner

*Primary Examiner* — David Gray
*Assistant Examiner* — Erika J Villaluna
(74) *Attorney, Agent, or Firm* — Fitzpatrick, Cella, Harper & Scinto

(57) ABSTRACT

A developing device includes a developer carrying member for carrying a magnetic developer to form a developer image on an image bearing member; a developing device frame including a first accommodating chamber for accommodating the magnetic developer and including a second accommodating chamber, in which the developer carrying member is provided, for accommodating the magnetic developer supplied from the first accommodating chamber through a first opening; a removable sealing member for sealing the first opening; and a magnetic seal, provided between a longitudinal end portion of the developer carrying member and the developing device frame. The sealing member is removable through a second opening which is defined at least partly by the magnetic seal.

5 Claims, 15 Drawing Sheets

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(c)

(a)

(b)

DEVELOPING DEVICE

FIELD OF THE INVENTION AND RELATED ART

The present invention relates to a developing device for developing an electrostatic latent image formed on an electrophotographic photosensitive member.

In an image forming apparatus for forming an image on a latent image bearing member by using an electrophotographic process, a process cartridge type has been conventionally employed. In the process cartridge type, the electrophotographic photosensitive member and process means acting on the electrophotographic photosensitive member are integrally assembled into a cartridge, and the cartridge is configured to be detachably mountable to a main assembly of the image forming apparatus. According to this process cartridge type, a user can perform maintenance of the apparatus by himself (herself) without relying on a service person, so that operativity can be remarkably improved. For that reason, this process cartridge type has been widely used in the image forming apparatus.

A schematic structure of a developing device 210 incorporated into a process cartridge 200 is shown in (*a*) of FIG. 15. A method in which a seal member of a magnetic material (hereinafter referred to as a magnetic seal) 210*i* is provided at both end portions, with a predetermined spacing, of a rotatably provided developing sleeve 210*d* to prevent toner from flowing into an area other than a developing area in the developing device 210 as shown in (*a*) of FIG. 15 has been proposed. The magnetic seal 210*i* is magnetized in a magnetic N and S pole pattern as shown in (*b*) of FIG. 15. Thus, a gap between an outer peripheral surface of the developing sleeve 210*d* and a surface of the magnetic seal 210*i* is filled by a magnetic brush of a chain of the toner formed along magnetic lines of force, so that the toner is prevented from flowing into the area other than the developing area. The magnetic seal 210*i* is also magnetized at a surface on a developing device frame 210*b* side, so that the toner is prevented from flowing into an area other than the developing area from a gap between the magnetic seal 210*i* and the developing device 210 which fixes the magnetic seal 210*i*.

Such a developing device frame 210*b* of the developing device 210 includes a developing portion 210*b*9 where the developing sleeve 210*d* for supplying the toner to the electrostatic latent image formed on an electrophotographic photosensitive member (hereinafter referred to as a photosensitive drum) 207 is disposed, and includes a toner accommodating portion 210*b*1 for accommodating the toner. Here, in the process cartridge 200, a toner seal member (sealing member) 210*h* for sealing the toner accommodating portion 210*b*1 is provided.

When the toner is discharged from the toner accommodating portion 210*b*1 to the developing sleeve 210*d*at the time of start of use of the process cartridge 200, first, an operation for pulling out and removing the toner seal member 210*h*from the outside of the process cartridge 200 to unseal the toner accommodating portion 210*b*1. As a result, the toner accommodated in the toner accommodating portion 210*b*1 is discharged and supplied toward the developing sleeve 210*d*side through an unsealed (uncovered) developing opening device 210*b*11. For this reason, as the toner seal member 210*h*, a member, which is generally called a toner seal film, for sealing the developing opening 210*b*11 of the toner accommodating portion 210*b*1 is used.

Japanese Laid-Open Patent Application (JP-A) Hei 9-26743discloses a constitution in which a slit for permitting pulling-out of the toner seal member from the outside of the developing device (hereinafter referred to as a toner seal opening) is provided in the developing device frame, and the toner seal member is inserted through the toner seal opening to expose an end portion thereof to the outside of the developing device. In this constitution, after the toner seal member is inserted, the toner seal opening is blocked with a cap member which is an elastic member for preventing toner leakage.

JP-A 2000-75620 discloses a constitution in which a toner accommodating portion frame and a developing portion frame are prepared as separate members and an end portion of a toner seal member is exposed to the outside of the developing device by sandwiching the toner seal member at a toner seal opening formed when the toner accommodating portion frame and the developing device frame are connected. In this constitution, at a portion, contacted to the toner seal member, of one of the toner accommodating portion frame and the developing device frame, a raising end portion seal member is disposed.

However, in the above-described constitution, a part for confining the toner, such as a cap member is required. Further, in the constitution, the toner seal opening is hermetically sealed with the cap member or the end portion seal member and therefore a force for pulling out the toner seal member becomes large, so that there is a possibility that usability is impaired.

SUMMARY OF THE INVENTION

A principal object of the present invention is to provide a developing device capable of easily assembling an opening for permitting pulling-out of a toner seal member for sealing a toner accommodating chamber to an outside thereof without increasing the number of parts while suppressing a pulling-out force of the toner seal member without loss of a toner sealing function.

According to an aspect of the present invention, there is provided a developing device comprising:

a developer carrying member for carrying a magnetic developer to form a developer image on an image bearing member;

a developing device frame including a first accommodating chamber for accommodating the magnetic developer and including a second accommodating chamber, in which the developer carrying member is provided, for accommodating the magnetic developer supplied from the first accommodating chamber through a first opening;

a removable sealing member for sealing the first opening; and a magnetic seal, provided between a longitudinal end portion of the developer carrying member and the developing device frame, wherein the sealing member is removable through a second opening which is defined at least partly by the magnetic seal.

According to another aspect of the present invention, there is provided a developing device comprising:

a developer carrying member for carrying a magnetic developer to form a developer image on an image bearing member;

a developing device frame including a first accommodating chamber for accommodating the magnetic developer and including a second accommodating chamber, in which the developer carrying member is provided, for accommodating the magnetic developer supplied from the first accommodating chamber through a first opening;

a removable sealing member for sealing the first opening, wherein the sealing member is removable through a second opening; and a magnetic seal, provided between a longitudinal end portion of the developer carrying member and the developing device frame, for preventing the magnetic developer from moving to an outside of the developing device through the second opening.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Parts (*a*) and (*b*) of FIG. 1 are schematic views showing a structure of a process cartridge in Embodiment 1.

Parts (*a*), (*b*) and (*c*) of FIG. 2 are schematic views for illustrating a toner seal member.

Figure 3:
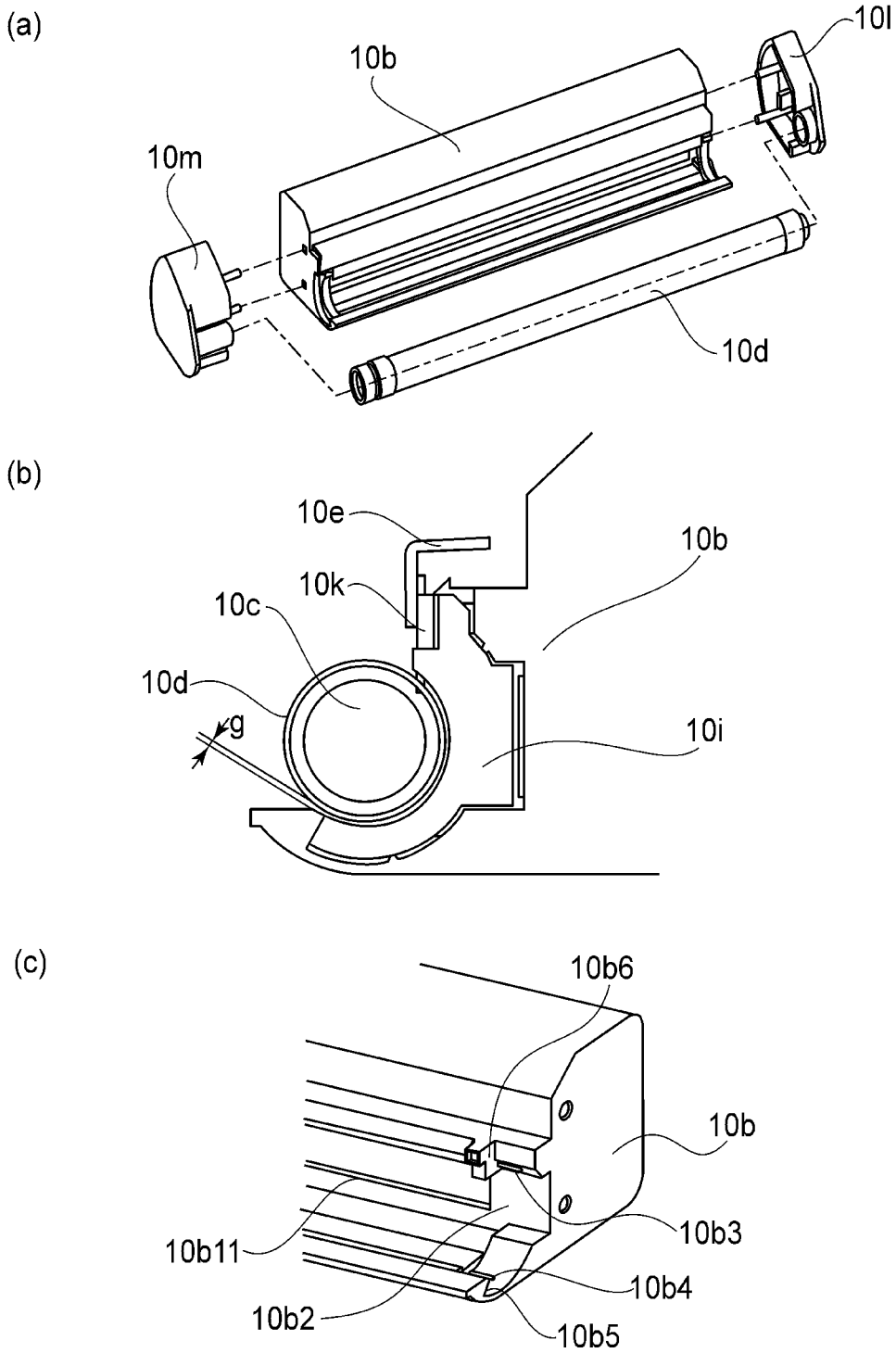

Parts (*a*), (*b*) and (*c*) of FIG. 3 are schematic views for illustrating a developing device frame and a developing sleeve in Embodiment 1.

Figure 4:
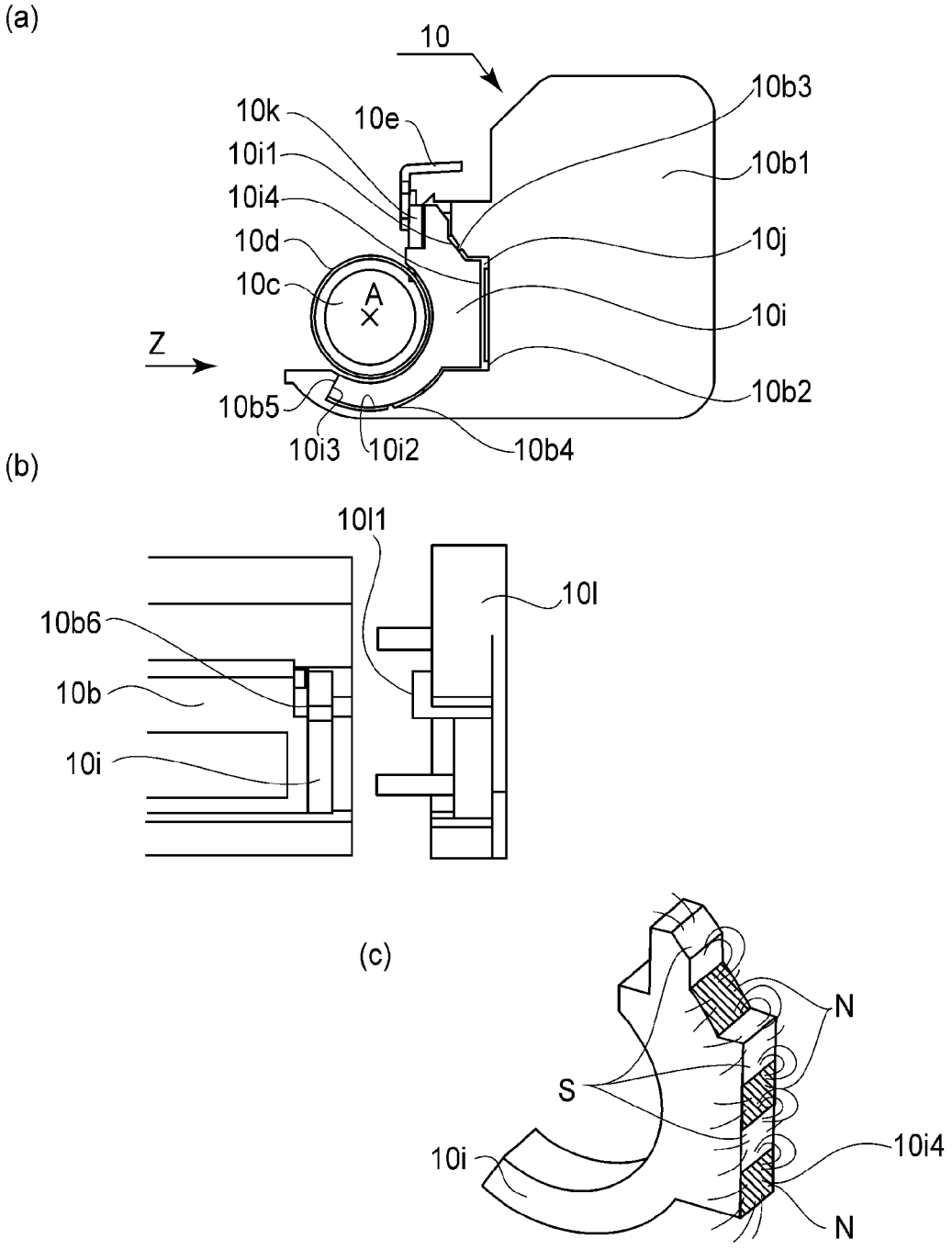

Parts (*a*), (*b*) and (*c*) of FIG. 4 are schematic views showing a structure of a developing device in Embodiment 1.

Figure 5:
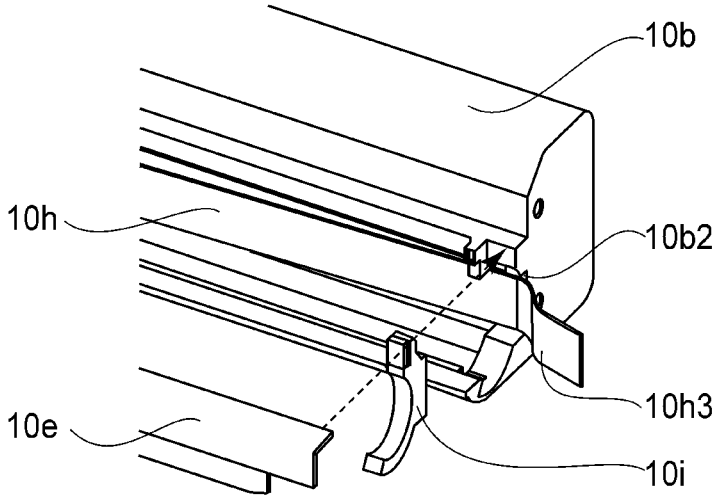
Figure 5:
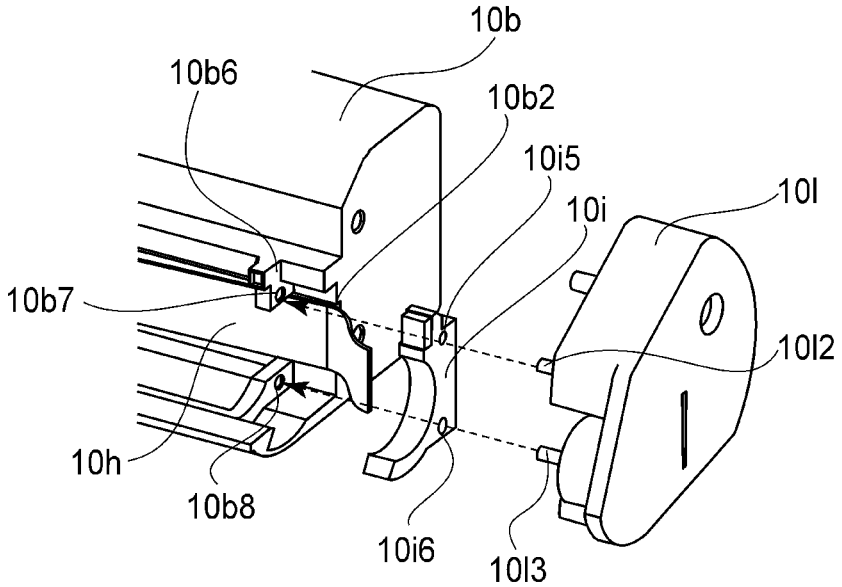

Parts (*a*) and (*b*) of FIG. 5 are schematic views for illustrating a mounting method of the toner seal member in Embodiment 1.

Figure 6:
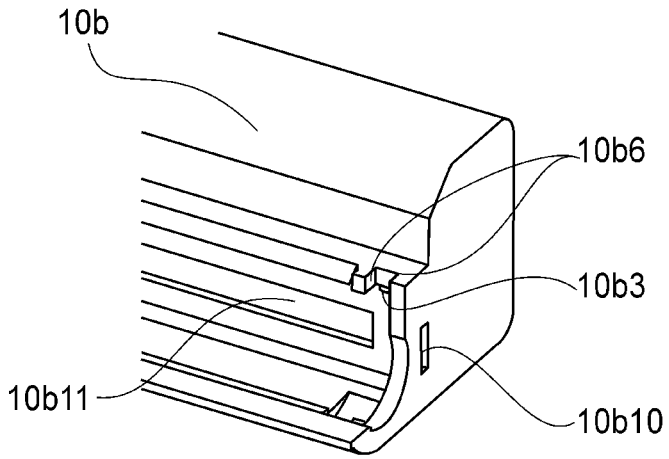
Figure 6:
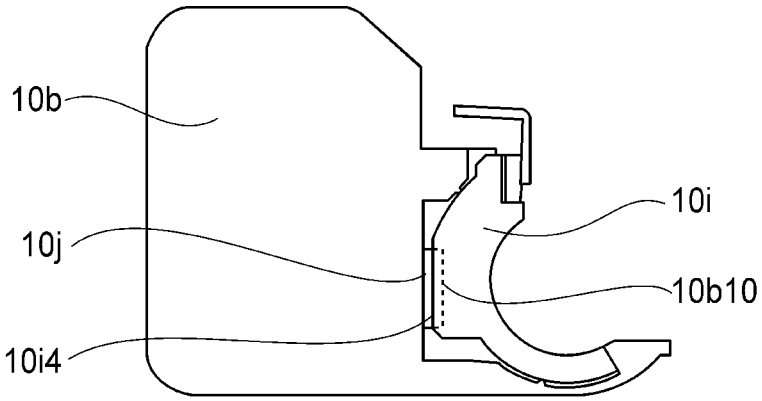

Parts (*a*) and (*b*) of FIG. 6 are schematic views showing principal portions of a process cartridge in Embodiment 2.

Figure 7:
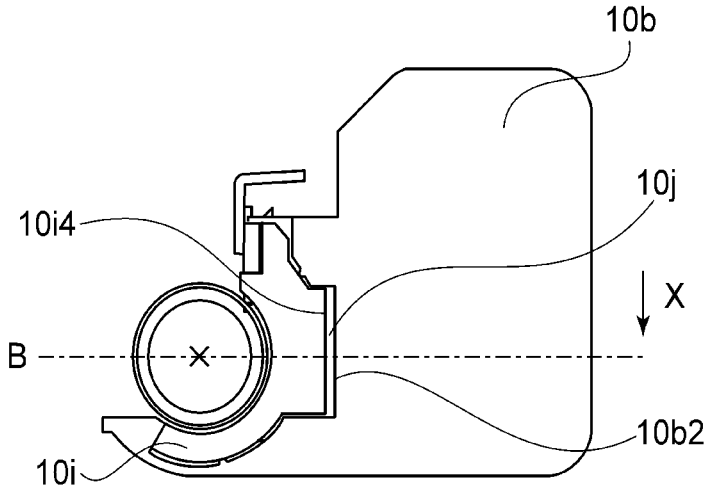
Figure 7:
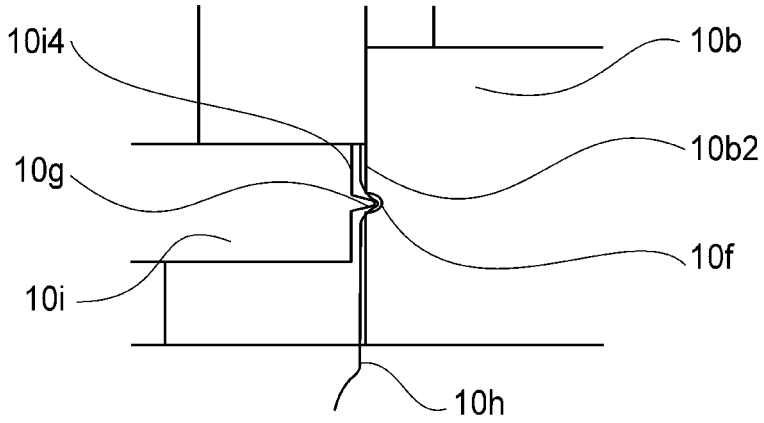
Figure 8:
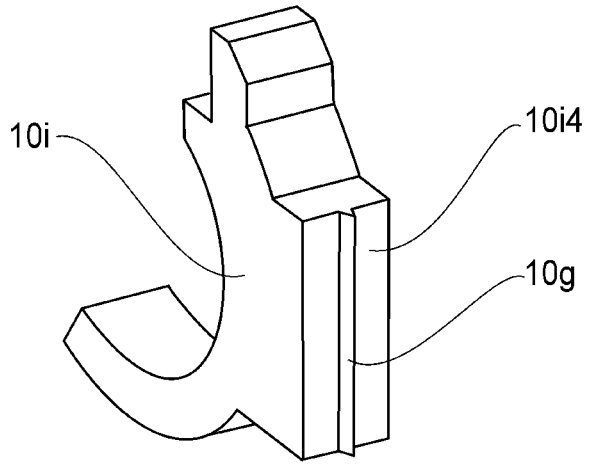
Figure 8:
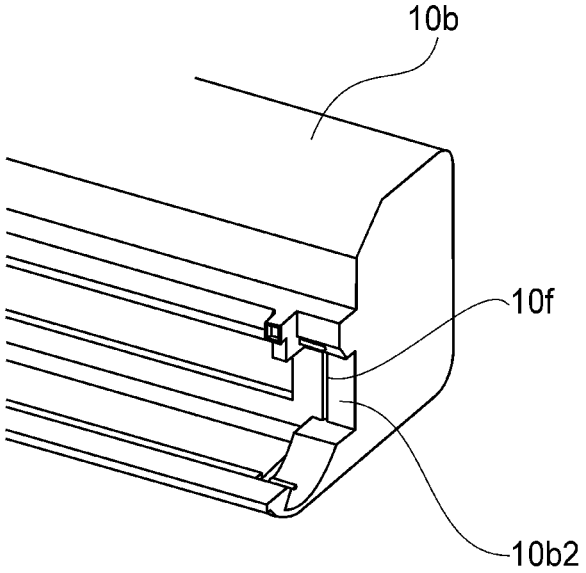
Figure 9:
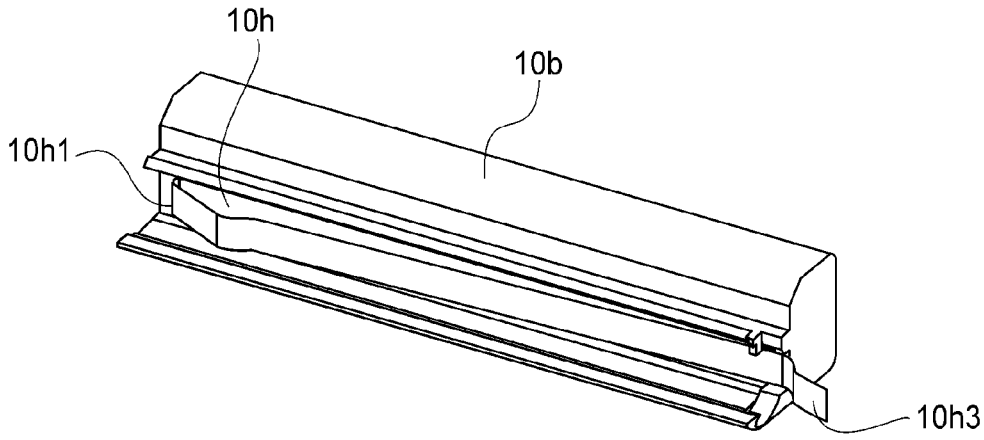
Figure 9:
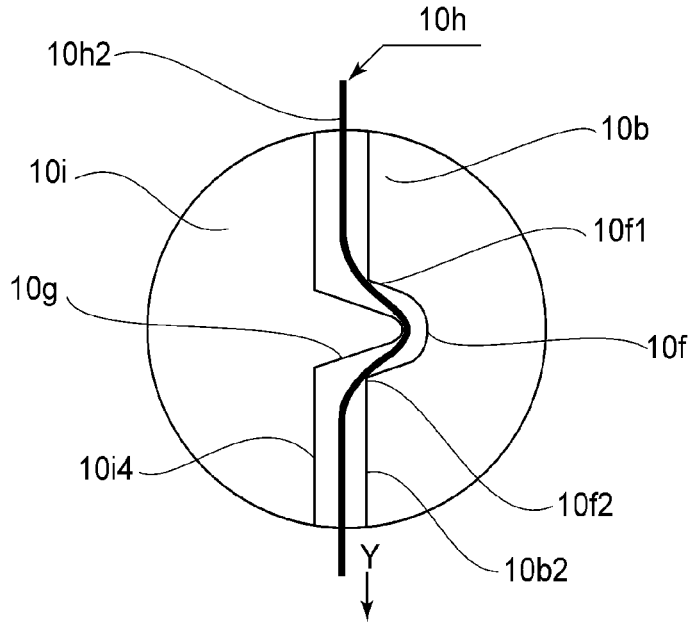
Figure 10:
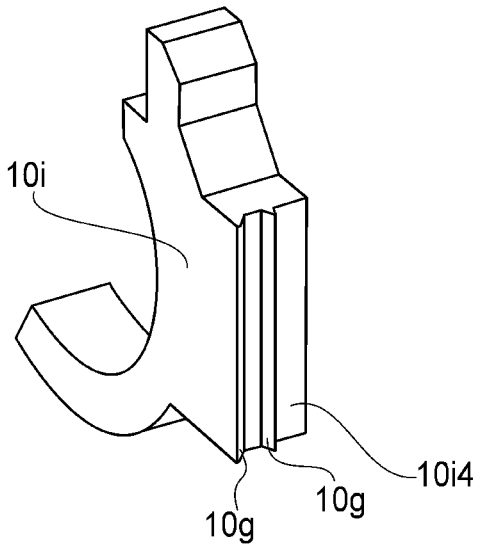
Figure 10:
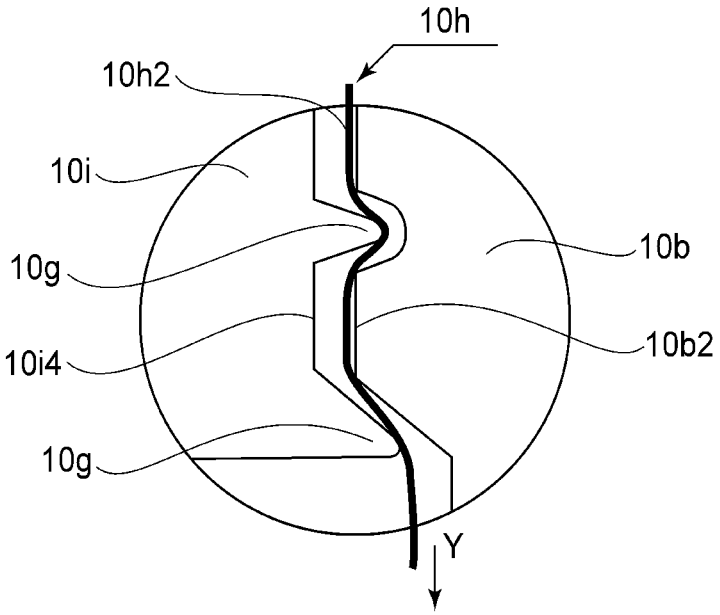

Parts (*a*) and (*b*) of FIG. 7, (*a*) and (*b*) of FIG. 8, (*a*) and (*b*) of FIG. 9 and (*a*) and (*b*) of FIG. 10 are schematic views showing principal portions of a process cartridge in Embodiment 3.

Figure 11:
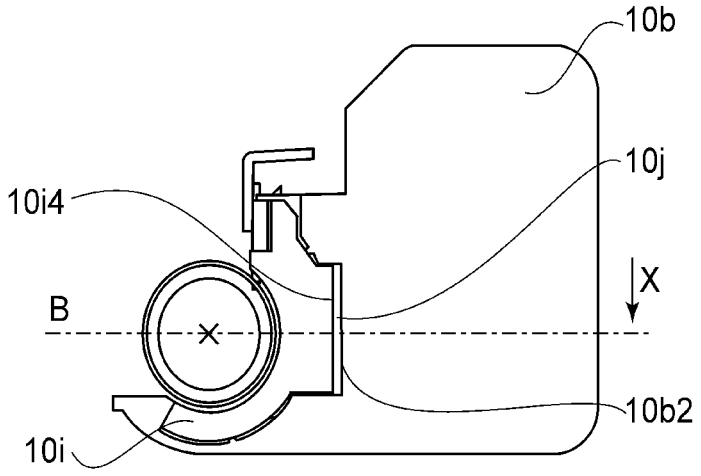
Figure 11:
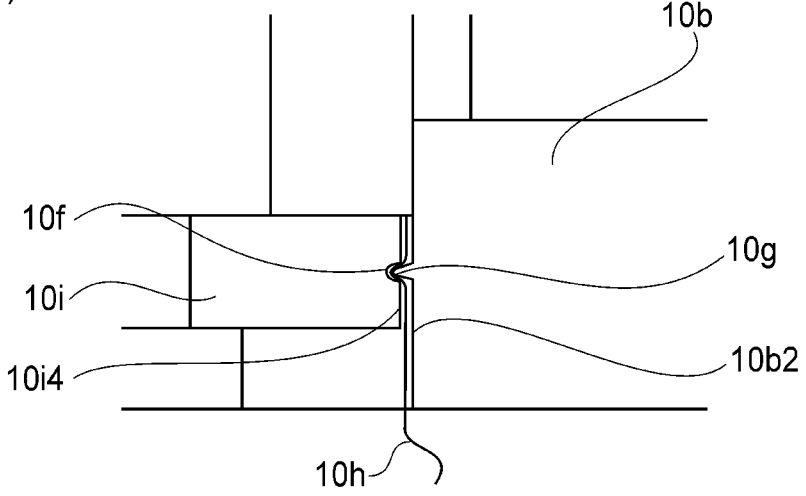
Figure 12:
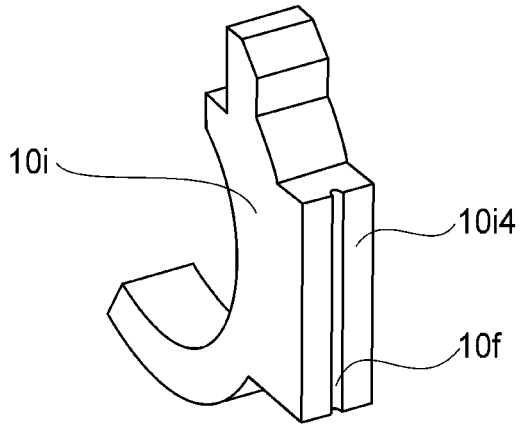
Figure 12:
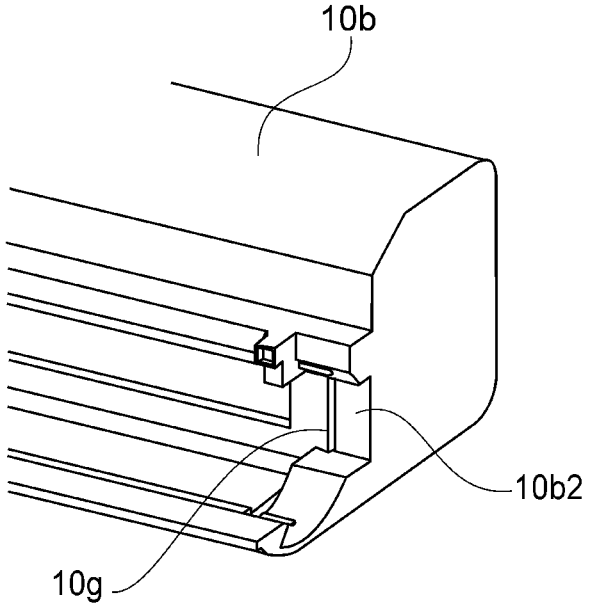
Figure 13:
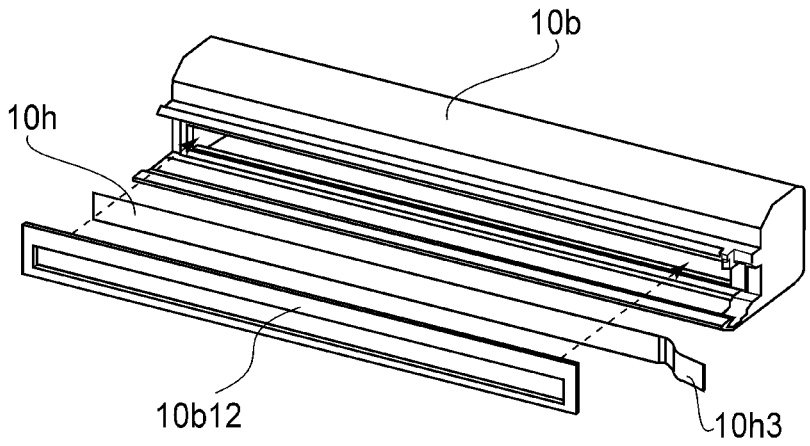
Figure 13:
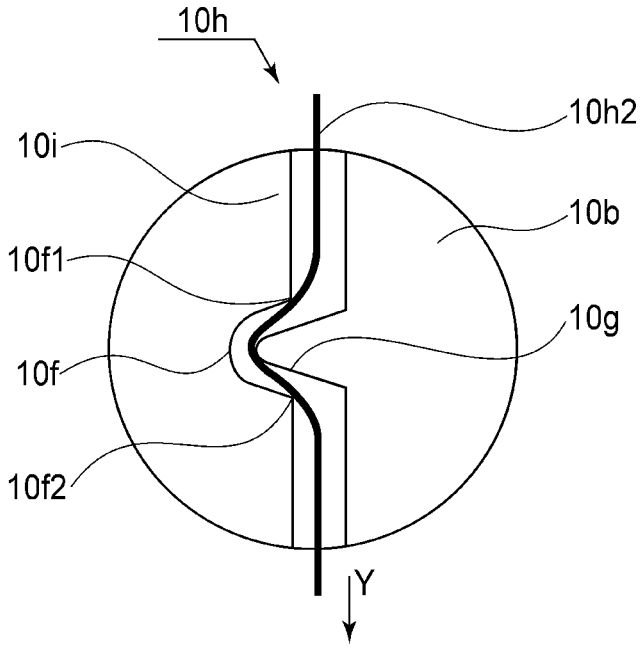

Parts (*a*) and (*b*) of FIG. 11, (*a*) and (*b*) of FIG. 12 and (*a*) and (*b*) of FIG. 13 are schematic views showing principal portions of a process cartridge in Embodiment 4.

Figure 14:
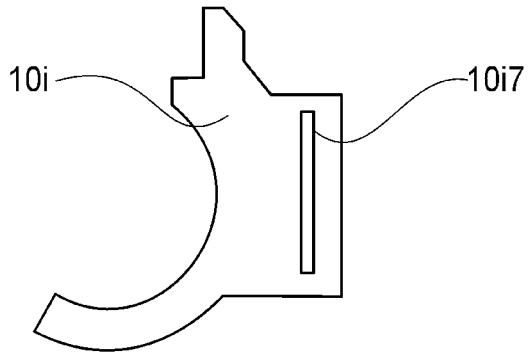
Figure 14:
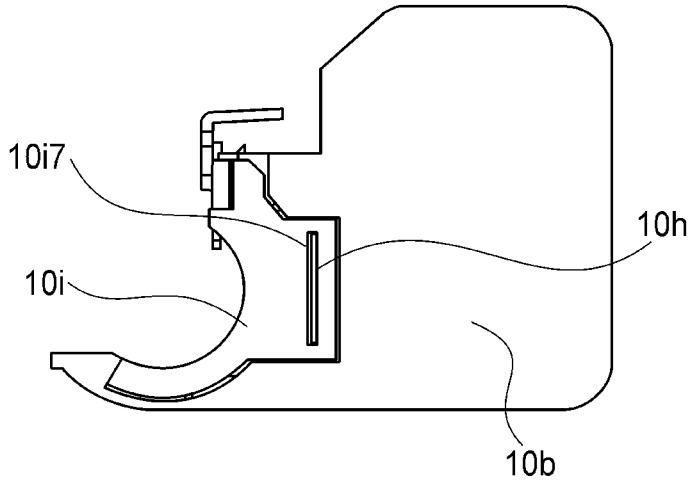
Figure 14:
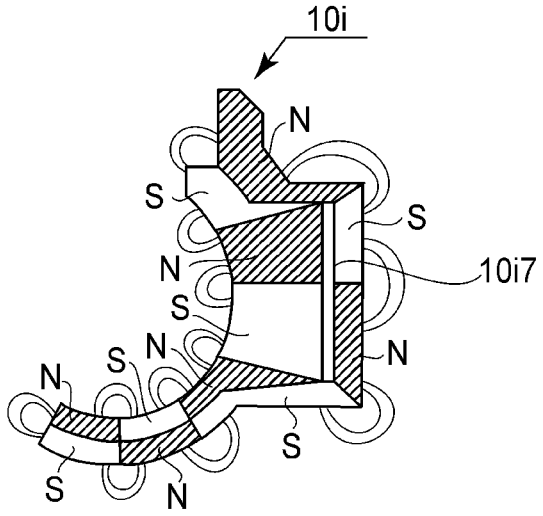

Parts (*a*), (*b*) and (*c*) of FIG. 14 are schematic views showing principal portions of a process cartridge in Embodiment 5.

Figure 15:
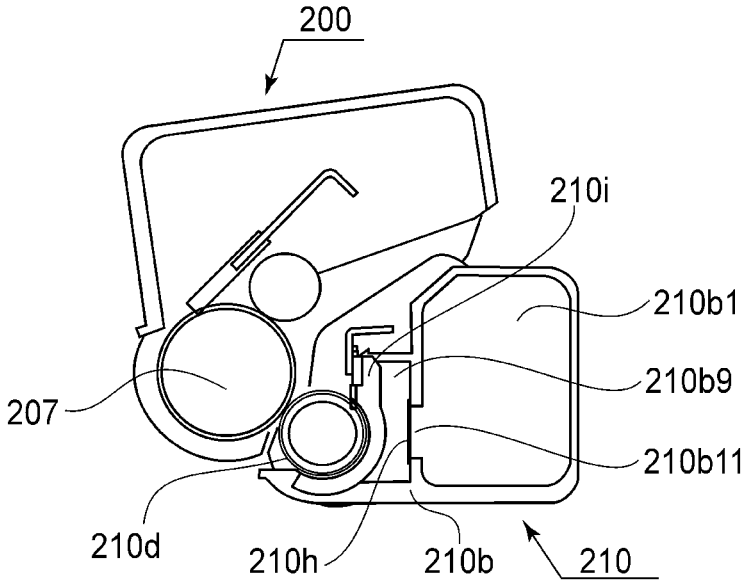
Figure 15:
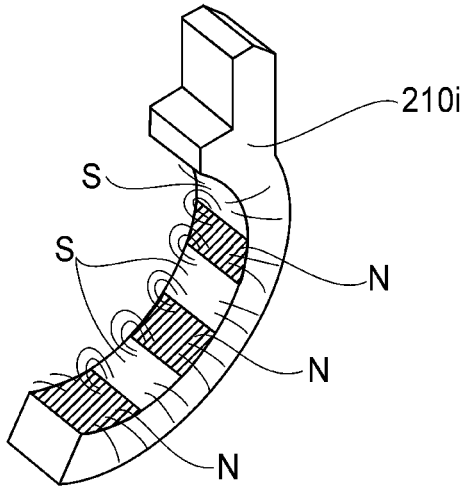

Parts (*a*) and (*b*) of FIG. 15 are schematic views showing a conventional process cartridge.

DESCRIPTION OF THE PREFERRED EMBODIMENTS

Hereinbelow, embodiments for carrying out the present invention will be exemplarily and specifically described with reference to the drawings. However, dimensions, materials, shapes, relative arrangements and the like of constituent elements described in the following embodiments are appropriately changed depending on constitutions or various conditions of devices (apparatuses) to which the present invention is applied and thus the scope of the present invention is not limited thereto.

In the following embodiments, as a developer, magnetic toner (hereinafter simply referred to as toner) is used. Further, sectional views and sectional shapes in the embodiments are based on a cross section with respect to a direction perpendicular to a rotational axis of a developing sleeve 10*d* as a developer carrying member for carrying the toner for use in development of an electrostatic latent image formed on an electrophotographic photosensitive member. Further, the rotational axis direction of the developing sleeve 10*d* is a longitudinal direction.

(Embodiment 1)

Figure 1:
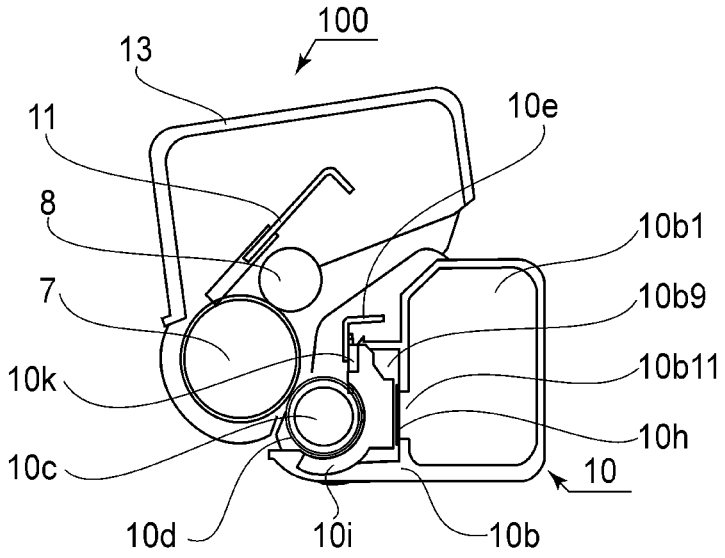
Figure 1:
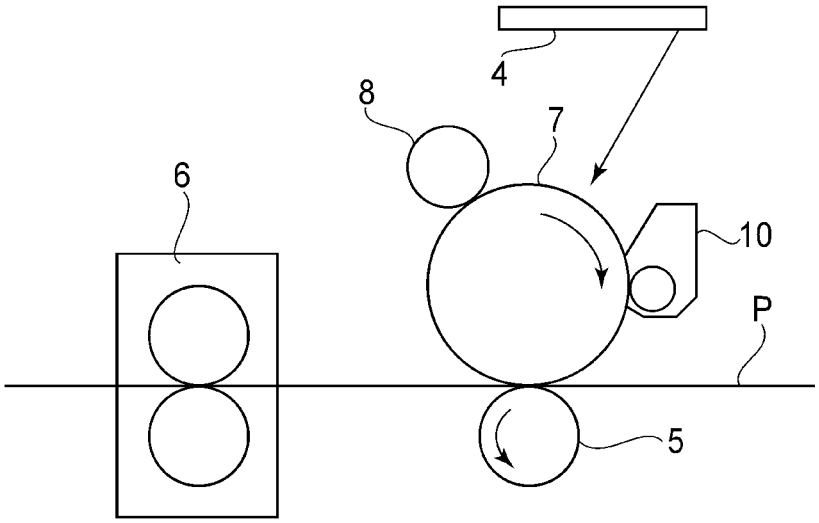

Part (*a*) of FIG. 1 is a sectional view showing a schematic structure of a process cartridge in this embodiment, and (*b*) of FIG. 1 is a schematic structural view for illustrating an image forming operation of an image forming apparatus in this embodiment. First, with reference to (*b*) of FIG. 1, the image forming operation of the image forming apparatus will be described. On a surface of a drum-like latent image bearing member (hereinafter referred to as a photosensitive drum) 7 as an electrophotographic photosensitive member uniformly charged by a charging device 8, an electrostatic latent image is formed by irradiation with laser light emitted from a scanner unit 4 correspondingly to image information. Then, this electrostatic latent image is developed into a toner image by a developing device (developing means) 10 and thereafter is transferred onto a recording material P by a transfer device 5. Then, the toner image on the recording material P is heated by a heating device 6 to be fixed on the recording material, so that an image is formed on the recording material P.

Next, with reference to (*a*) of FIG. 1, the process cartridge in this embodiment will be described. In this embodiment, a process cartridge 100 includes the photosensitive drum 7 and at least one process means. Here, examples of the process means include the charging device 8 for electrically charging the surface of the photosensitive drum 7, the developing device 10 for forming the toner image on the photosensitive drum 7, a cleaning means 11 for removing the toner remaining on the photosensitive drum 7, and the like. The process cartridge 100 is prepared by disposing the charging device 8 and the cleaning means 11 at a periphery of the photosensitive drum 7, and these means are covered with a housing constituted by a cleaning frame 13, a developing device frame 10*b* and the like, thus being assembled into a cartridge.

The developing device 10 contained in the process cartridge 100 is constituted by a toner accommodating portion 10*b*1 and the developing device frame 10*b* including a developing portion 10*b*9. Here, the toner accommodating portion 10*b*1 corresponds to a first accommodating chamber for accommodating the toner, and the developing portion 10*b*9 corresponds to a second accommodating chamber for accommodating the toner to be carried on the developing sleeve 10*d* and for being supplied with the toner from the toner accommodating portion 10*b*1 (the first accommodating chamber).

The developing device frame 10*b* of the developing device 10 is rotatably provided with the developing sleeve 10*d* for carrying and feeding the toner in the developing portion 10*b*9 (the toner accommodating portion 10*b*1) to the photosensitive drum 7.

The toner accommodating portion 10*b*1 is provided with an opening 10*b*11 as a first opening for permitting feeding of the toner to the developing sleeve 10*d* and a toner seal member 10*h* for sealing (covering) the developing device opening 10*b*11.

Figure 2:
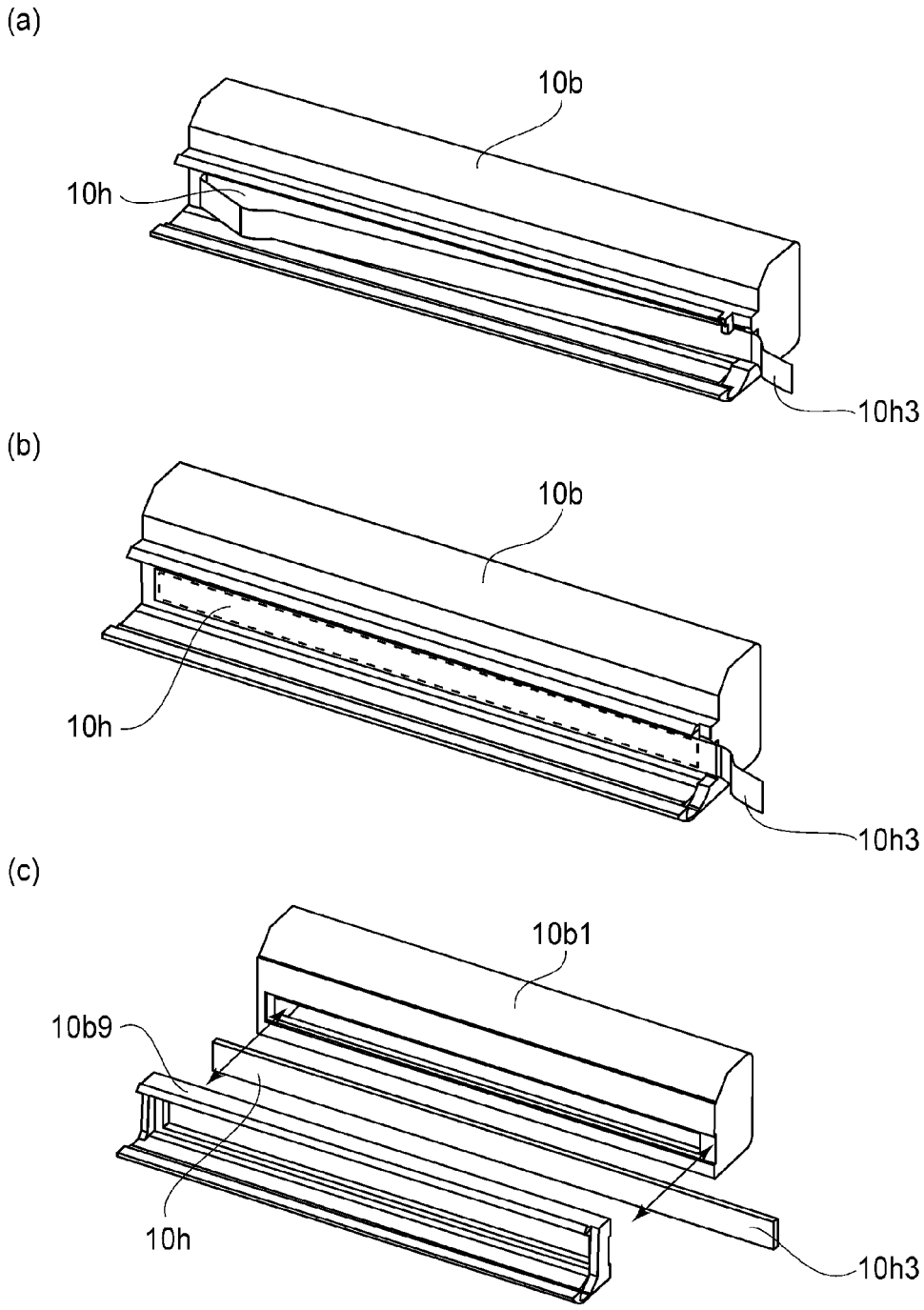

Parts (*a*), (*b*) and (*c*) of FIG. 2 are schematic views for illustrating the toner seal member 10*h*. The toner seal member 10*h* is disposed to cover the developing device opening when the developing device 10 is not yet used, thus confirming the magnetic toner in the toner accommodating portion 10*b*1. Then, at the time of use, an end portion 10*h*3 of the toner seal member 10*h* is pulled out and thus the toner seal member 10*h* is pulled out to the outside of the developing device 10, so that the developing device opening 10*b*11 can be uncovered.

Specifically, as shown in (*a*) of FIG. 2, there is a constitution in which the toner seal member 10*h* constituted by a film or the like is separably applied onto the developing device opening 10*b*11 so that it is folded back at a side opposite from the pulling-out side. In this constitution, the toner seal member 10*h* is removed by pulling out the end portion 10*h*3 at the pulling-out side of the toner seal member 10*h*.

Further, as shown in (*b*) of FIG. 2, there is also a constitution in which the toner seal member 10 constituted by a film or the like is separably applied onto the developing device opening 10*b*11 and is not folded on the side opposite from the pulling-out side, different from the constitution of (*a*) of FIG. 2. Also in this constitution, the toner seal member 10*h* is removed by pulling out the end portion 10*h*3 at the pulling-out side of the toner seal member 10*h*.

Further, as shown in (*c*) of FIG. 2, there is also a constitution in which the toner seal member 10*h* is held in a pullable state by being sandwiched between the developing portion 10*b*9 and the toner accommodating portion 10*b*1 and is removed by pulling out the end portion 10*h*3 of the toner seal member 10*h*.

Part (*a*) of FIG. 3 is a schematic view for illustrating the developing device frame 10*b* and the developing sleeve 10*d*. The developing sleeve 10*d* contains a magnet member 10*c* and is rotatably supported by a non-driving side holder member 10*l* and a driving side holder member 10*m* which are supported by longitudinal end portions of the developing device frame 10*b*. The toner supplied from the toner accommodating portion 10*b*1 is deposited on the surface of the surface of the developing sleeve 10*d* by a magnetic force of the magnet member 10*c*. Then, the toner on the developing sleeve 10*d* is regulated to have a constant layer thickness and thereafter is deposited on the latent image on the photosensitive drum 7 at a position, in which the developing sleeve 10*d* opposes the photosensitive drum 7, by rotation of the developing sleeve 10*d*.

Part (*b*) of FIG. 3 is a partial sectional view of the developing device 10. At end portions of the developing sleeve 10*d* with respect to the longitudinal direction, a pair of seal members of a magnetic material, i.e., magnetic seals 10*i* with a predetermined spacing (gap) between the outer peripheral surface of the developing sleeve 10*d* and themselves are provided. Each magnetic seal 10*i* generates a magnetic force for carrying the toner in the gap between the outer peripheral surface of the developing sleeve 10*d* and the magnetic seal 10*i*. By providing the magnetic seal 10*i*, the gap between the outer peripheral surface of the developing sleeve 10*d* and the surface of the magnetic seal 10*i* is blocked by a magnetic brush of a chain of the toner formed by magnetic lines of force, so that the toner is prevented from flowing into an area out of a developing area.

The magnetic seals 10*i* are, as shown in (*b*) of FIG. 3, provided at end portions of the developing sleeve 10*d* so as to be disposed with a predetermined gap g with respect to the outer peripheral surface of the developing sleeve 10*d*, and are attached to the developing sleeve 10*d* and the developing device frame 10*d* in this state.

Part (*c*) of FIG. 3 is a partial perspective view of the developing device frame 10*b*. The developing device frame 10*b* includes a first position projection 10*b*3 and a second positioning projection 10*b*4 which are configured to position the magnetic seal 10*i*, a rotation stopping surface 10*b*5 for stopping the rotation of the magnetic seal 10*i*, and an opening forming portion 10*b*2 which is a part of a toner seal opening 10*j*. Here, the toner seal opening 10*j* is a second opening through which the toner seal member 10*h* to be pulled out at the time of start of use passes and through which a part (the end portion 10*h*3) of the toner seal member 10*h* is pulled out (exposed) to the outside of the developing device 10 when the developing device 10 is not yet used.

Further, at a base portion of the developing device frame 10*b* at a side of the developing device opening 10*b*11 with respect to the longitudinal direction of the first positioning projection 10*b*3, a longitudinal positioning surface 10*b*6 for positioning the magnetic seal 10*i* with respect to the longitudinal direction is provided.

Part (*a*) of FIG. 4 is a sectional view showing a schematic structure of the developing device 10. The magnetic seal 10*i* includes a leakage preventing surface 10*i*4 as a part of the toner seal opening 10*j*, a first positioning surface 10*i*1 and a second positioning surface 10*i*2 which are configured to position the magnetic seal 10*i* relative to the developing device frame 10*b*, and a rotation stopping surface 10*i*3 at which the rotation of the magnetic seal 10*i* is to be stopped. Each of the first positioning surface 10*i*1 and the second positioning surface 10*i*2 has an arcuate shape with a rotation center A of the developing sleeve 10*d* as its center.

Each magnetic seal 10*i* is positioned by contact of the first positioning surface 10*i*1 and the second positioning surface 10*i*2 thereof with the first positioning projection 10*b*3 and the second positioning projection 10*b*4 of the developing device frame 10*b*, respectively, and then a developing blade 10*e* is assembled with the magnetic seal 10*i*. As a result, a push pad 10*k* provided between the developing blade 10*e* and the magnetic seal 10*i* is compressed, and the magnetic seal 10*i* is rotated about the rotation center A of the developing sleeve 10*d* by a repelling force of the push pad 10*k* generated at that time. Thus, the rotation stopping surface 10*i*3 abuts against the rotation stopping surface 10*b*5, so that an attitude of the magnetic seal 10*i* is determined.

Part (*b*) of FIG. 4 is a schematic view of the developing device 10 as seen from the Z direction of (*a*) of FIG. 4. The magnetic seal 10*i* is positioned with respect to the longitudinal direction by abutment thereof against the longitudinal positioning surface 10*b*6, and a retaining surface 10*l*1 of the non-driving side holder member 10*l* constitutes a retaining portion for the magnetic seal 10*i* and thus is fixed. The developing sleeve 10*d* is, as shown in (*a*) of FIG. 3, rotatably supported by the non-driving side holder member 10*l* and the driving side holder member 10*m*. As a result, (an inner peripheral surface of) the toner seal opening 10*j* is defined (constituted) by the leakage preventing surface 10*i*4 as a part of the magnetic seal 10*i* and the opening forming portion 10*b*2 as a part of the developing device frame 10*b*.

Part (*c*) of FIG. 4 is a schematic view showing a N and S magnetic pole pattern of the leakage preventing surface 10*i*4 of the magnetic seal 10*i*.

In this embodiment, movement of the toner through the toner seal opening 10*j* toward the outside of the developing device 10 is suppressed by carrying the toner by the magnetic force generated by the magnetic seal 10*i*. That is, by the magnetic brush of the chain of the toner formed by magnetic lines of force at the leakage preventing surface 10*i*4, the gap (the toner seal opening 10*j*) between the leakage preventing surface 10*i*4 and the opening forming portion 10*b*2 is blocked so that the toner leakage to the outside of the developing device 10 is prevented.

By constituting the toner seal opening 10*j* as described above, even when there is no sealing member such as the cap member or the end portion seal member which are configured to confine the toner, it becomes possible to prevent the toner leakage to the outside of the developing device 10 by the magnetic force of the magnetic seal 10*i* at the leakage preventing surface 10*i*4. Thus, the toner leakage to the outside of the developing device 10 can be prevented by the magnetic force of the magnetic seal 10*i* at the leakage preventing surface 10*i*4, so that a force required when the toner seal member 10*h* is pulled out can be reduced and therefore usability (convenience) can be improved.

Part (*a*) of FIG. 5 is a schematic view for illustrating a mounting method of the toner seal member 10*h* in the developing device 10. As shown in (*a*) of FIG. 5, in the above constitution, an assembling method in which the end portion 10*h*3 of the toner seal member 10*h* is disposed at the opening forming portion 10*b*2 of the developing device frame 10*b* and thereafter the magnetic seal 10*i* is mounted can be employed. As a result, the assembling can be easily performed by only placing the toner seal member 10*h* on the opening forming portion 10*b*2 of the developing device frame 10*b* at the toner seal opening 10*j*.

Part (*b*) of FIG. 5 is an exploded perspective view of the developing device 10, in which a positioning constitution of the magnetic seal 10*i* capable of obtaining the same effect as that of the constitution described above. Incidentally, for the sake of explanatory convenience, the developing device 10*d* is omitted.

In this constitution, a positioning boss 1012 and a rotation stopping boss 1013 which are provided on the non-driving holder member 101 are engaged into a positioning hole 10*i*5 and a rotation stopping hole 10*i*6, respectively, which are provided in the magnetic seal 10*i*. Further, the positioning boss 10*l*2 and the rotation stopping boss 10*l*3 are engaged into a first frame hole 10*b*7 and a second frame hole 10*b*8, respectively, which are provided in the developing device frame 10*b*. As a result, the non-driving side holder member 10*l* and the magnetic seal 10*i* are positioned and fixed to the developing device frame 10*b*. Even in such an assembling constitution of the magnetic seal 10*i*, it becomes possible to easily assemble the toner seal member 10*h* similarly as in the assembling method described above.

(Embodiment 2)

In this embodiment, constituents or portions similar to those in Embodiment 1 are represented by the same reference numerals or symbols, thus being omitted from the description.

Part (*a*) of FIG. 6 is a partial perspective view of the developing device frame 10*b* in this embodiment. The toner accommodating portion 10*b*1 and the developing portion 10*b*9 are constituted as an integral developing device frame 10*b*. The developing device frame 10*b* includes a frame opening 10*b*10 through which the toner seal member 10*h* is to be passed when the toner seal member 10*h* is exposed to the outside of the developing device 10.

The developing device frame 10*b* includes a longitudinal positioning surface 10*b*6 in the neighborhood of the first positioning projection 10*b*3. The longitudinal direction of the magnetic seal 10*i* is positioned by engaging the magnetic seal 10*i* with the longitudinal position surface 10*b*6 with respect to a width thereof.

Part (*b*) of FIG. 6 is a schematic view showing a structure in the case where a cross section of the developing device 10 including the developing opening 10*b*11 is illustrated so as to show the magnetic seal 10*i*. The magnetic seal 10*i* includes the leakage preventing surface 10*i*4 and is fixed to the developing device frame 10*b* so as to cover a part of the frame opening 10*b*10 at the leakage preventing surface 10*i*4.

In this embodiment, a gap formed between the leakage preventing surface 10*i*4 of the magnetic seal 10*i* and the part of the frame opening 10*b*10 constitutes the toner seal opening 10*j* through which the toner seal member 10*h* is to be passed and through which the end portion 10*h*3 of the toner seal member 10*h* is to be exposed to the outside of the developing device 10.

By constituting the toner seal opening 10*j* as described above, also in this embodiment, it is possible to achieve the same effect as that in Embodiment 1.

(Embodiment 3)

In this embodiment, constituents or portions similar to those in Embodiment 1 are represented by the same reference numerals or symbols, thus being omitted from the description.

Part (*a*) of FIG. 7 is a sectional view showing a structure of the developing device 10 in this embodiment, and (*b*) of FIG. 7 is a schematic view of a cross section of the developing device 10 taken along a chain line B indicated in (*a*) of FIG. 7 and as seen from a direction indicated by an arrow X in (*a*) of FIG. 7.

At the leakage preventing surface 10*i*4 of the magnetic seal 10*i*, a wiping projection 10*g* as a projection projected in a direction of the opening forming portion 10*b*2 of the developing device frame 10*b* is provided. At the opening forming portion 10*b*2 of the developing device frame 10*b*, a wiping recess portion 10*f* where the wiping projection 10*g* enters is provided. The wiping recess portion 10*f* is configured so that it is not contacted to the wiping projection 10*g* and is spaced from the leakage preventing surface 10*i*4 by a predetermined distance.

Part (*a*) of FIG. 8 is a schematic perspective view of the magnetic seal 10*i* in this embodiment. The wiping projection 10*g* is extended over the entire leakage developing sleeve 10*i*4 with respect to a direction perpendicular to the pulling-out direction of the toner seal member 10*h*. Part (*b*) of FIG. 8 is a schematic perspective view of the developing device frame 10*b*. The wiping recess portion 10*f* is extended over the entire opening forming portion 10*b*2 with respect to the direction perpendicular to the pulling-out direction of the toner seal member 10*h*.

Part (*a*) of FIG. 9 is a schematic perspective view of the developing device frame 10*b*. The toner seal member 10*h* is a film-like elongated sheet member and includes a folding-back portion (intermediate portion) 10*h*1 where the toner seal member 10*h* is folded back at an end portion opposite from the side on which the toner seal opening 10*j* is formed.

When the developing device 10 is not yet used, one end and the other end of the elongated toner seal member 10*h* are disposed at the side where the toner seal opening 10*j* for the toner seal member 10*h* is provided. The one end of the toner seal member 10*h* is disposed at an end portion of the developing opening 10*b*11 at the side where the toner seal opening 10*j* is disposed with respect to the longitudinal direction of the developing opening 10*b*11. Further, at an opposite end portion from the end portion of the developing opening 10*b*11 at the side where the toner seal opening 10*j* is disposed with respect to the longitudinal direction of the developing opening 10*b*11, the folding-back portion 10*h*1 is disposed. In this embodiment, the developing opening 10*b*11 is covered by applying thereto the toner seal member 10*h* from the one end of the toner seal member 10*h* to the folding-back portion 10*h*1. The end portion 10*h*3 which is the other end, with respect to the longitudinal direction, of the toner seal member 10*h* is folded back at the folding-back portion 10*h*1 and then is pulled out through the toner seal opening 10*j* to the outside of the developing device 10, thus being exposed.

Part (*b*) of FIG. 9 is a schematic view showing a state in which the toner seal member 10*h* shown in (*b*) of FIG. 7 is pulled out in a pulling-out direction indicated by an arrow Y.

A developing opening surface 10*h*2 which is a surface of the toner seal member 10*h* opposing the developing opening 10*b*11 is constituted to the toner in order to prevent the toner from moving from the toner accommodating portion 10*b*1 to the developing portion 10*b*9. The developing opening surface 10*b*2 is constituted by an area (portion) from the one end of the toner seal member 10*h* to the folding-back portion 10*h*1.

Here, the developing opening surface 10*h*2 corresponds to a coating surface at which the developing opening 10*b*11 is covered to suppress the movement of the toner contained in the toner accommodating portion 10*b*1 when the developing device 10 is not yet used.

The toner seal member 10*h* is pulled out while a back surface opposite from the developing opening surface 10*h*2 is contacted to a first corner portion 10*f*1 and a second corner portion 10*f*2 and while the developing opening surface 10*h*2 is contacted to the wiping projection 10*g*.

By the constitution as described above, in this embodiment, in addition to the effect obtained in Embodiment 1, the following effect can be achieved. That is, when the toner seal member 10*h* is pulled out (i.e., when the toner seal member 10*h* passes through the toner seal opening 10*j*), the wiping projection 10*g* provided on the magnetic seal 10*i* can remove the toner deposited on the developing opening surface 10*h*2 of the toner seal member 10*h*. Here, the wiping projection 10*g* is provided and extended over the entire leakage preventing surface 10*i*4 with respect to a direction perpendicular to the pulling-out direction of the toner seal member 10*h*. As a result, when the toner seal member 10*h* is pulled out, the wiping projection 10*g* can be contacted to the entire area of the developing opening surface 10*h*2, so that the toner deposited on the developing opening surface 10*h*2 can be removed with high reliability.

Therefore, even when there is no cap member or the like for confining the toner, it becomes possible to remove, when the toner seal member 10*h* is pulled out, the toner deposited on the developing opening surface 10*h*2.

Parts (*a*) and (*b*) of FIG. 10 are schematic views showing a form in which a plurality of projections 10*g* are provided on the leakage preventing surface 10*i*4 of the magnetic seal 10*i*, in which (*a*) of FIG. 10 is a perspective view and (*b*) of FIG. 10 is a sectional view. As shown in (*a*) and (*b*) of FIG. 10, it is possible to further reliably remove the toner by providing the plurality of projections 10*g* on the leakage preventing surface 10*i*4 of the magnetic seal 10*i*.

Incidentally, in this embodiment, the wiping projection 10*g* is provided on the leakage preventing surface 10*i*4 of the magnetic seal 10*i* but the present invention is not limited thereto. That is, the wiping projection 10*g* may be provided on at least either one of the leakage preventing surface 10*i*4 of the magnetic seal 10*i* and the opening forming portion 10*b*2 of the developing device frame 10*b*. The wiping projection 10*g* may more preferably be provided on a portion, of the leakage preventing surface 10*i*4 and the opening forming portion 10*b*2, where it opposes the developing opening surface 10*h*2 when the toner seal member 10*h* passes through the toner seal opening 10*j*. Further, in this embodiment, the opening forming portion 10*b*2 is provided with a wiping recess portion 10*f* is provided but the present invention is not limited thereto. That is, a constitution in which the wiping recess portion 10*f* is not provided at the opening forming portion 10*b*2 may also be employed.

(Embodiment 4)

In this embodiment, constituents or portions similar to those in Embodiments 1 to 3 are represented by the same reference numerals or symbols, thus being omitted from the description.

In Embodiment 3, the wiping projection 10*g* was provided on the leakage preventing surface 10*i*4 of the magnetic seal 10*i*, and the wiping recess portion 10*f* was provided at the opening forming portion 10*b*2 of the developing device frame 10*b*. On the other hand, in this embodiment, the wiping projection 10*g* is provided on the opening forming portion 10*b*2 of the developing device frame 10*b*, and the wiping recess portion 10*f* is provided at the leakage preventing surface 10*i*4 of the magnetic seal 10*i*. Here, in this embodiment, for the sake of explanatory convenience, a projection (projected portion) provided on the opening forming portion 10*b* of the developing device frame 10*b* is referred to as the wiping projection 10*g*, and the recess portion (recessed portion) provided at the leakage preventing surface 10*i*4 of the magnetic seal 10*i* is referred to as the wiping recess portion 10*f*.

Part (*a*) of FIG. 11 is a sectional view showing a structure of the developing device 10 in this embodiment, and (*b*) of FIG. 11 is a schematic view of a cross section of the developing device 10 taken along a chain line B indicated in (*a*) of FIG. 11 and as seen from a direction indicated by an arrow X in (*a*) of FIG. 11.

At the opening forming portion 10*b*2 of the developing device frame 10*b*, a wiping projection 10*g* projected in a direction of the leakage preventing surface 10*i*4 of the magnetic seal 10*i* is provided. At the leakage preventing surface 10*i*4 of the magnetic seal 10*i*, a wiping recess portion 10*f* where the wiping projection 10*g* enters is provided. The wiping recess portion 10*f* is configured so that it is not contacted to the wiping projection 10*g* and is spaced from the leakage preventing surface 10*i*4 by a predetermined distance.

Part (*a*) of FIG. 12 is a schematic perspective view of the magnetic seal 10*i* in this embodiment. The recess portion 10*f* is extended over the entire leakage developing surface 10*i*4 with respect to a direction perpendicular to the pulling-out direction of the toner seal member 10*h*. Part (*b*) of FIG. 12 is a schematic perspective view of the developing device frame 10*b*. The wiping projection 10*g* is extended over the entire opening forming portion 10*b*2 with respect to the direction perpendicular to the pulling-out direction of the toner seal member 10*h*.

Part (*a*) of FIG. 13 is a schematic perspective view of the developing device frame 10*b*. The toner seal member 10*h* is a film-like sheet member. Further, the toner seal member 10*h* is provided on the developing device frame 10*b* by being slidably interposed between the developing device frame 10*b* and a toner seal fixing member 10*b*12 fixed to the developing device frame 10*b* by welding or the like. The end portion 10*h*3 of the toner seal member 10*h* passes through the toner seal opening 10*j* and is pulled out to the outside of the developing device 10. The developing opening surface 10*h*2 which is a surface of the toner seal member 10*h* where the toner seal member 10*h* opposes the developing device opening 10*b*11, is contacted to the toner in order to confine the toner so as not to move from the toner accommodating portion 10*b*1 to the developing portion 10*b*9.

Part (*b*) of FIG. 13 is a schematic view showing a state in which the toner seal member 10*h* shown in (*b*) of FIG. 11 is pulled out in a pulling-out direction indicated by an arrow Y. The toner seal member 10*h* is pulled out while a back surface opposite from the developing opening surface 10*h*2 is contacted to a first corner portion 10*f*1 and a second corner portion 10*f*2 and while the developing opening surface 10*h*2 is contacted to the wiping projection 10*g*.

By the constitution as described above, similarly as in Embodiment 3, the wiping projection 10*g* provided on the developing device frame 10*b* can remove the toner deposited on the developing opening surface 10*h*2 of the toner seal member 10*h*. Therefore, even when there is no cap member or the like for confining the toner, it becomes possible to remove, when the toner seal member 10*h* is pulled out, the toner deposited on the developing opening surface 10*h*2.

(Embodiment 5)

In this embodiment, constituents or portions similar to those in Embodiments 1 to 4 are represented by the same reference numerals or symbols, thus being omitted from the description.

Part (*a*) of FIG. 14 is a sectional view showing a structure of the magnetic seal 10*i* in this embodiment. The magnetic seal 10*i* includes a through slit 10*i*7.

Part (*b*) of FIG. 14 is a schematic sectional view of the developing device 10. In this embodiment, the through slit 10*i*7 is configured, as a portion corresponding to the toner seal opening 10*j* in the embodiments described above, so that the end portion 10*h*3 of the toner seal member 10*h* can pass through the through slit 10*i*7 and can be pulled out from the outside the developing device 10.

Part (*c*) of FIG. 14 is a schematic view showing a magnetic pole pattern of the magnetic seal 10*i*. The through slit 10*i*7 of the magnetic seal 10 is blocked with a magnetic brush of a chain of the toner formed along magnetic lines of force, so that the toner is prevented from flowing to the outside of the developing device 10.

By the constitution as described above, the toner leakage to the outside of the developing device 10 can be prevented by the magnetic force of the through slit 10*i*7, as the toner seal opening 10*j*, of the magnetic seal 10*i*, so that it is possible to obtain an effect similar to that in Embodiment 1 also in this embodiment.

As described above, by employing the constitution in Embodiments 1 to 5, it is possible to constitute the toner seal opening 10*j* which can be easily assembled on the developing device 10 and permits a small pulling-out force of the toner seal member 10*h* without impairing the toner seal function and without increasing the number of parts.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 097113/2010 filed Apr. 20, 2010, which is hereby incorporated by reference.

What is claimed is:

1. A developing device comprising:

a developer carrying member for carrying a magnetic developer to form a developer image on an image bearing member;

a developing device frame including a first accommodating chamber for accommodating the magnetic developer and including a second accommodating chamber, in which said developer carrying member is provided, for accommodating the magnetic developer supplied from said first accommodating chamber through a first opening;

a sealing member, which is provided to seal the first opening, and which is to be removed by being passed through a second opening; and a magnetic seal member, which is provided between a longitudinal end portion of said developer carrying member and said developing device frame, forming at least part of the second opening, wherein said magnetic seal member can carry the magnetic developer in a gap between an outer peripheral surface of said developer carrying member and said magnetic seal member, and can carry the magnetic developer at the second opening to suppress movement of the magnetic developer to an outside of said developing device by a magnetic force, wherein the second opening is a slit provided in said magnetic seal member.

2. A device according to claim 1, wherein the second opening is provided with a projection for scraping off the magnetic developer deposited on said sealing member when said sealing member passes through the second opening.

3. A device according to claim 2, wherein the second opening is provided with a recess portion, and the projection enters the recess portion.

4. An image forming apparatus comprising:

an image bearing member; and a developing device according to claim 1.

5. An image forming apparatus comprising:

an image bearing member; and a developing device according to claim 1.

* * * * *